US008777167B2

(12) United States Patent
Su et al.

(10) Patent No.: US 8,777,167 B2
(45) Date of Patent: Jul. 15, 2014

(54) STRAIN RELIEVING ELEMENT MOLDED ON A CABLE

(75) Inventors: Ping-Sheng Su, New Taipei (TW); Jun Chen, Kunshan (CN); Feng-Jun Qi, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 46 days.

(21) Appl. No.: 13/303,010

(22) Filed: Nov. 22, 2011

(65) Prior Publication Data

US 2012/0125661 A1 May 24, 2012

(30) Foreign Application Priority Data

Nov. 22, 2010 (CN) ..... 2010 2 0617382

(51) Int. Cl.
*H01R 13/627* (2006.01)
*H01R 3/00* (2006.01)

(52) U.S. Cl.
USPC ..... 248/49; 248/56; 174/135; 439/447

(58) Field of Classification Search
CPC ..... H01R 31/06
USPC ..... 248/49, 56; 439/352, 353, 358, 490, 439/607.46, 607.48, 447, 455; D13/147; 174/135
See application file for complete search history.

(56) References Cited

U.S. PATENT DOCUMENTS

| | | | | | |
|---|---|---|---|---|---|
| 2,727,088 | A * | 12/1955 | La Wall | 174/135 |
| 3,032,737 | A * | 5/1962 | Rottmann | 439/446 |
| 3,395,244 | A * | 7/1968 | Koehler | 174/135 |
| 3,721,939 | A * | 3/1973 | Paugh | 439/354 |
| 3,800,068 | A * | 3/1974 | Torgerson | 174/135 |
| 4,310,213 | A * | 1/1982 | Fetterolf et al. | 439/320 |
| 4,568,047 | A * | 2/1986 | Matsui | 248/56 |
| 5,340,330 | A * | 8/1994 | Dolson et al. | 439/447 |
| 7,288,000 | B2 * | 10/2007 | Liu et al. | 439/447 |
| 7,758,373 | B2 * | 7/2010 | Zhou et al. | 439/490 |
| 7,785,136 | B2 * | 8/2010 | Zhang et al. | 439/490 |
| 2005/0026492 | A1 * | 2/2005 | Zhang et al. | 439/358 |

* cited by examiner

*Primary Examiner* — Anita M King
(74) *Attorney, Agent, or Firm* — Wei Te Chung; Ming Chieh Chang

(57) ABSTRACT

A strain relieving element, comprising: a front surface, a rear surface opposite to the front surface, an intermediate portion connecting the front surface to the rear surface, a receiving passage passing through the front surface and the rear surface, a plurality of through cavities recessing inwardly from the intermediate portion and communicated with the receiving passage and a plurality of the notches recessing inwardly from the intermediate portion and apart from the receiving passage. The distance between the notches and the rear surface are closer than the distance between the through cavities and the rear surface.

18 Claims, 8 Drawing Sheets

STRAIN RELIEVING ELEMENT MOLDED ON A CABLE

FIELD OF THE INVENTION

The present invention relates to a strain relieving element, and more particularly to a strain relieving element molded on a cable. The application relates to a copending application having the same inventors, the same assignee, the same title and the same filing date with the instant application.

DESCRIPTION OF PRIOR ART

Recently, more and more electrical devices have been widely spread and applied, such as notebooks, projectors and players, etc. Each of the electrical devices has a cable assembly connecting to a power supply or other electrical devices. The electrical devices are often not fixed in one place to use. A section of a cable connecting to the electrical device is suffered large torsional or bending stress and the cable may be damaged when the electrical device is moved. So, we need a method enhancing connecting strength between the cable and the electrical devices for protecting the cable from damaging. Nowadays, a strain relieving element which is molded on a junction between the cable and the electrical device can be overcame the above problems. However, in existing technology, the design of the strain relieving element has some problems that: the stress of the strain relieving element being not entirely maximizing released and the strain relieving element or/and the cable being broken when using the electrical device.

As discussed above, an improved strain relieving element overcoming the shortages of existing technology is needed.

SUMMARY OF THE INVENTION

Accordingly, an object of the present invention is to provide a strain relieving element having a function with protecting a cable from damaging.

In order to achieve the above-mentioned objects, a strain relieving element, comprising: a front surface, a rear surface opposite to the front surface, an intermediate portion connecting the front surface to the rear surface, a receiving passage passing through the front surface and the rear surface, a plurality of through cavities recessing inwardly from the intermediate portion and communicated with the receiving passage and a plurality of the notches recessing inwardly from the intermediate portion and apart from the receiving passage. The distance between the notches and the rear surface are closer than the distance between the through cavities and the rear surface.

Other objects, features and advantages of the invention will be apparent from the following detailed description taken in connection with the accompanying drawings.

DETAILED DESCRIPTION OF PREFERRED EMBODIMENTS

Figure 1:
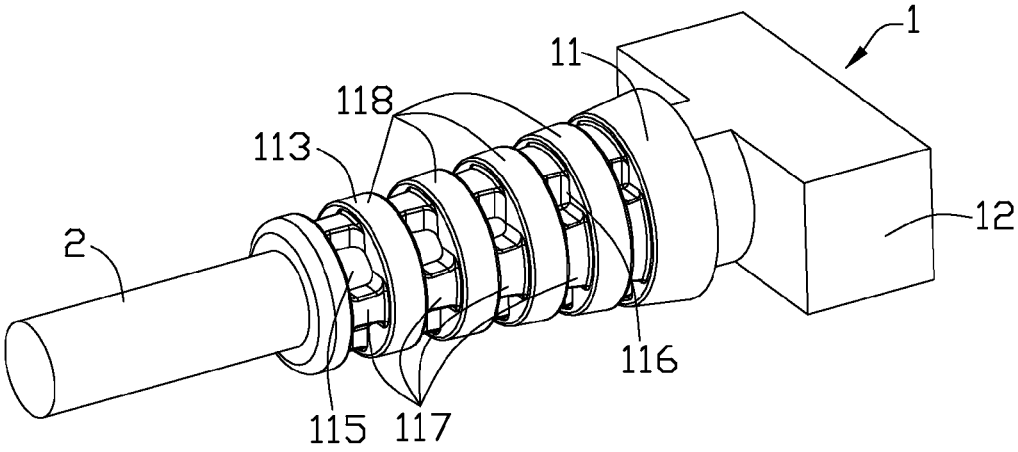
FIG. 1 is an assembled view of a strain relieving element of the first embodiment in accordance with the present invention connected to a cable.

Reference will now be made to the drawing figures to describe the present invention in detail.

Referring to FIGS. 1 to 6, a strain relieving element 1 of the first embodiment in accordance with the present invention is made of plastic and comprises a stress releasing portion 11 located on a front end thereof. In this embodiment, the stress releasing portion 11 is of truncated coned-typed. In other embodiments, the stress releasing portion 11 may be of rectangular or irregular shape. The stress releasing portion 11 defines a front surface 111, a rear surface 112 opposite to the front surface 111, an intermediate portion 113 between the front surface 111 and the rear surface 112 and a receiving passage 114 through the front and rear surface 111, 112. The diameter of the front surface 111 is smaller than the diameter of the rear surface 112. The area of the front surface 111 is smaller than the area of the rear surface 112.

Figure 2:
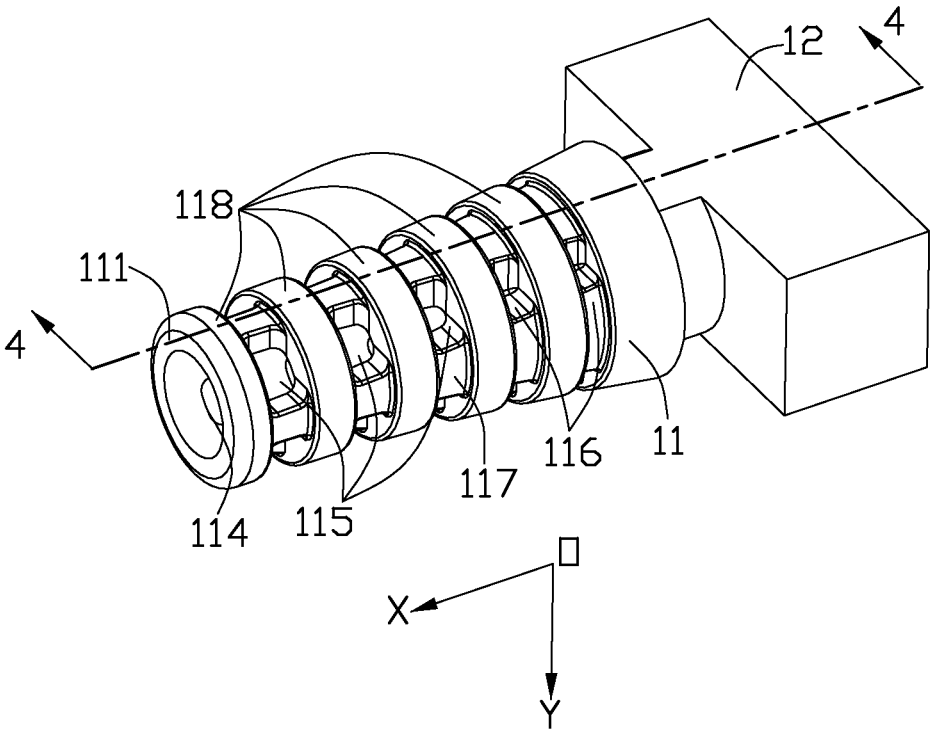
FIG. 2 is a perspective view of the strain relieving element shown in FIG. 1.
Figure 3:
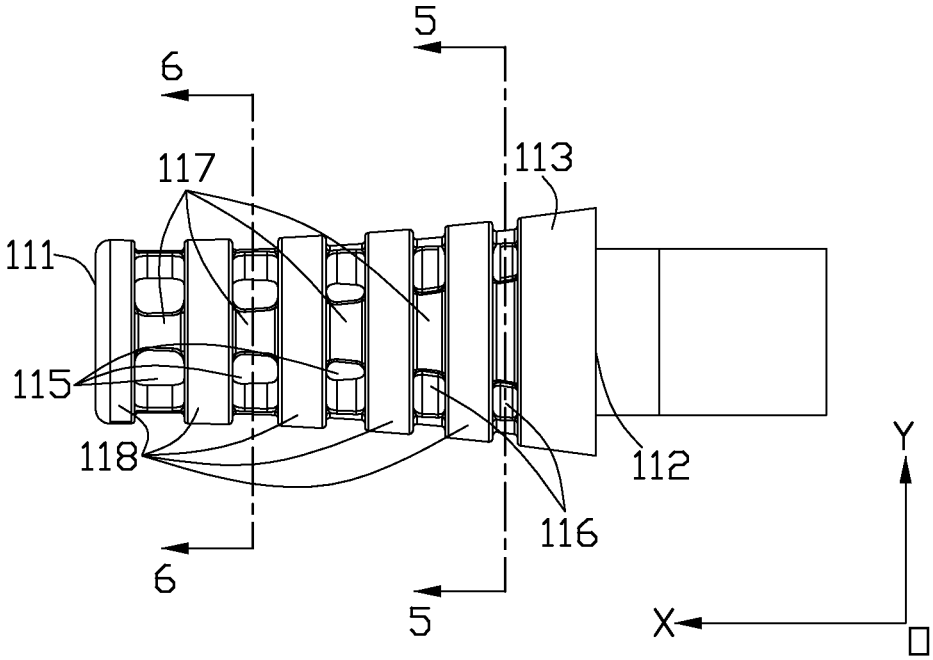
FIG. 3 is a plan view, taken along a XOY plan of the strain relieving element shown in FIG. 2.
Figure 4:
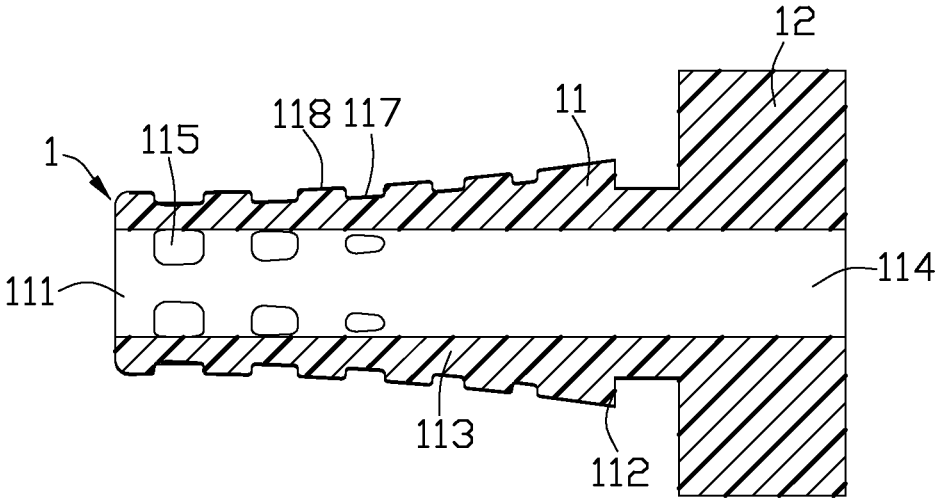
FIG. 4 is a cross-section view taken along line 4-4 shown in FIG. 2.
Figure 5:
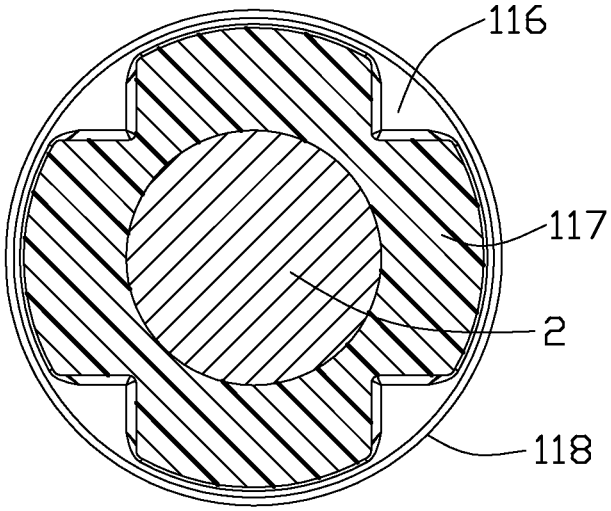
FIG. 5 is a cross-section view taken along line 5-5 shown in FIG. 3.
Figure 6:
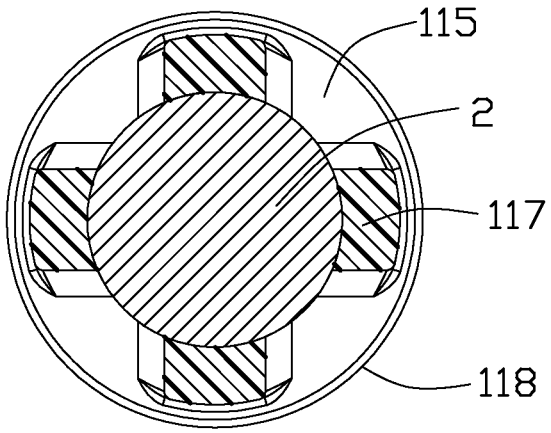
FIG. 6 is a cross-section view taken along line 6-6 shown in FIG. 3.

Referring to FIGS. 2 to 3, for conveniently describing the technical approach, we define a X-axis along a central axis of the stress releasing portion 11 (a direction from the center of the rear surface 112 to the center of the front surface 111) and a Y-axis with one of direction perpendicular to the X-axis. The X-axis and the Y-axis together form a XOY plan.

Referring to FIG. 2, The stress releasing portion 11 further comprises a plurality of through cavities 115 recessing inwardly from the intermediate portion 113 and communicated with the receiving passage 114. A plurality of notches 116 is formed by recessing inwardly from the intermediate portion 113 of the stress releasing portion 11. The notches 116 are apart from the receiving passage 114. A certain thickness is defined between the bottom of the notches 116 and the receiving passage 114. The distance from the notches 116 to the rear surface 112 is closer than the distance from the through cavities 115 to the rear surface 112.

Along the center axis direction of the stress releasing portion 11, the notches 116 are arranged in one row at least and the through cavities 115 are arranged in two rows at least. In this embodiment, the notches 116 are arranged in two rows and the through cavities 115 are arranged in three rows. There is at least one notch 116 in same row of the two rows of the notches 116, and all the notches 116 are arranged around the center axis of the stress releasing portion 11. There are the same number of through cavities 115 in a row and the notches 116 adjacent row of the cavities 115. The through cavities 115 are also arranged around the center axis of the stress releasing portion 11. In this embodiment, there are three the through cavities 115 in same row, and there are three notches 116 in same row. Ribs 117 are formed between the notches 116 in same row, and between the through cavities 115 in same row. Convexes or circumferential ribs 118 are formed between two adjacent rows of notches 116, between two adjacent rows of through cavities 115, between the notch 116 and the through cavities 115 and between two adjacent rows of the ribs 117. The height of the ribs 117 is equal to or lower than height of the convex 118 adjacent to the ribs 117. The distance of the same row of the notches 116 are gradually decreasing along the center axis direction of the stress releasing portion 11 from the rear surface 112 to the front surface 111. The distance of the same row of two through cavities 115 are gradually decreased along the center axis direction of the stress releasing portion 11 from the rear surface 112 to the front surface 111. That is the width of the ribs 117 being gradually decreased along the center axis direction of the stress releasing portion 11 from the rear surface 112 to the front surface 111. The length of the different rows of the notches 116 are gradually increased along the center axis direction of the stress releasing portion 11 from the rear surface 112 to the front surface 111. The length of the different rows of the through cavities 115 are gradually increased along the center axis direction of the stress releasing portion 11 from the rear surface 112 to the front surface 111. The length of the different rows of the ribs 117 are gradually increased along the center axis direction of the stress releasing portion 11 from the rear surface 112 to the front surface 111. That is the distance of two adjacent rows of the convexes 18 being gradually increasing along the center axis direction of the stress releasing portion 11 from the rear surface 112 to the front surface 111. The size of the different rows of the notches 116 are gradually increased along the center axis direction of the stress releasing portion 11 from the rear surface 112 to the front surface 111. The size of the different rows of the through cavities 115 are gradually increased along the center axis direction of the stress releasing portion 11 from the rear surface 112 to the front surface 111.

Projection on the XOY plan, Outer surfaces of the convexes 118 and the ribs 117 of the stress releasing portion 11 are of smooth arc shape, respectively. The radian of the smooth arc is gradually increased along the center axis direction of the stress releasing portion 11 from the rear surface 112 to the front surface 111. That is the arc being comprised of many different radius arcs are gradually increasing along the center axis direction of the stress releasing portion 11 from the rear surface 112 to the front surface 111. The distance between the convex 118 (or rib 117) near to the rear surface 112 and the center axis is longer than the distance between the convex 118 (rib 117) far from the rear surface 112 and the center axis.

Referring to FIG. 1, The strain relieving element 1 further comprises a connecting portion 12 extending rearwardly from the rear surface 112 and connecting to a connecting member (not shown). A cable 2 having a round columnar body thereof and connecting to the connecting member is received in the receiving passage 114 and the connecting portion 12. An outer surface of the cable 2 is exposed out of the through cavities 115 on the front of the stress releasing portion 11.

Figure 7:
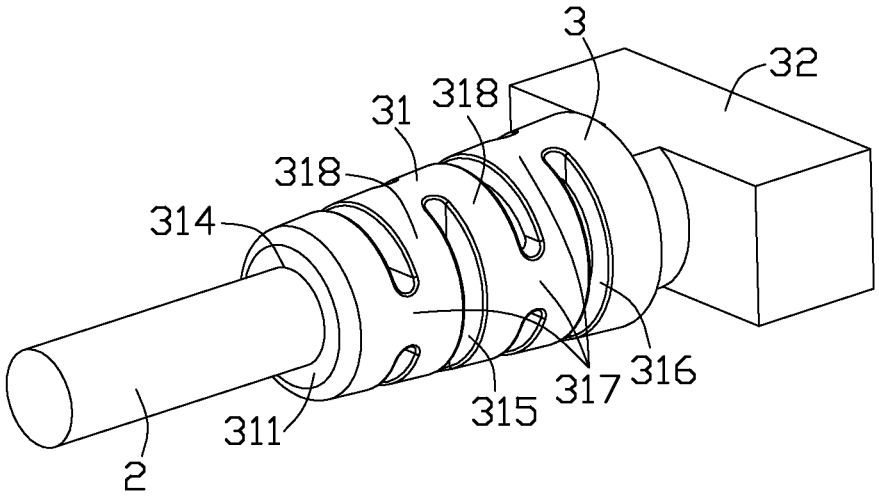
FIG. 7 is a perspective view of a strain relieving element of the second embodiment in accordance with the present invention.

Referring to FIG. 7, a strain relieving element 3 of the second embodiment made in accordance with the present invention comprises a stress releasing portion 31 and a connecting portion 32. In this embodiment, a receiving passage 314 is through a front surface 311 of the stress releasing portion 31 and a rear surface (not shown). A plurality of through cavities 315 are communicated with the receiving passage 314 and a plurality of notches 316 are apart from the receiving passage 314. In this embodiment, the through cavities 315 and the notches 316 respective are arranged in two rows, respectively. There is one through cavity 315 in same row of the two rows of the through cavities 315, and there is one notch 316 in same row of the two rows of the notches 316. Ribs 317 are defined between the row of the through cavity 315 and between the rows of the notch 316, respectively. Convexes 318 are defined between the adjacent rows of the notch 316, between the adjacent rows of the through cavities 315 and between the notch 316 and the through cavities 315, respectively. The adjacent rows of the convexes 318 are parallel. The rib 317 is connected to the adjacent rows of the convexes 318. The adjacent rows of the ribs 317 are crossed and connected by the convex 318. Between the outer surface of the ribs 317 and convexes 318 are smooth and connected natural transition, and both may be integrated. An outer surface of the cable 2 is exposed out of the through cavities 315 on the front of the stress releasing portion 31, and the rear portion of the stress releasing portion 31 encloses the cable 2.

Figure 8:
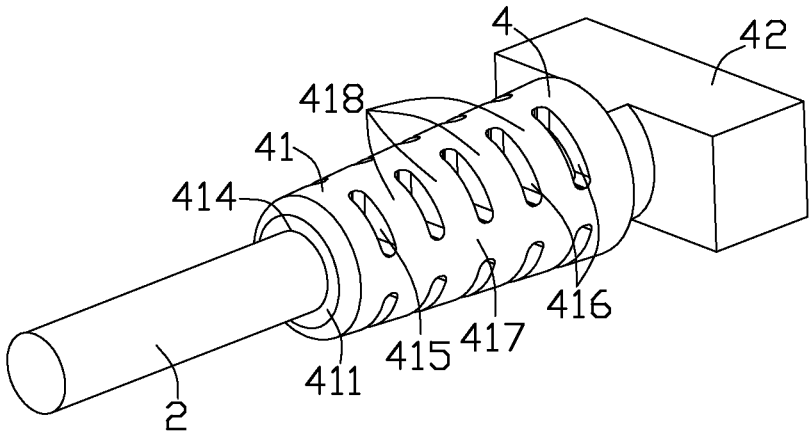
FIG. 8 is a perspective view of a strain relieving element of the third embodiment in accordance with the present invention.

Referring to the FIG. 8, a strain relieving element 4 of the third embodiment made in accordance with the present invention comprises a stress releasing portion 41 and a connecting portion 42. In this embodiment, a receiving passage 414 is through a front surface 411 of the stress releasing portion 41 and a rear surface (not shown). A plurality of through cavities 415 are communicated with the receiving passage 414 and a plurality of notches 416 are apart from the receiving passage 414. There are three rows of through cavities 415 and two rows of the notches 416. There are four through cavities 415 in one row, and there are four notches 416 in same row of the two rows of the notches 416. Ribs 417 are defined between the row of the through cavity 415 and between the row of the notch 416, respectively. Convexes 418 are defined between the adjacent rows of the notch 416, between the adjacent rows of the through cavities 415, between the notch 416 and the through cavities 415 and the adjacent rows of the ribs 417, respectively. The adjacent rows of the convexes 418 are parallel. The rib 417 is connected to the adjacent rows of the convexes 418. The convex 418 and the rib 417 are formed a "cross". The outer surface of the ribs 417 and convexes 418 are smooth and connected natural transition, and both may be integrated. An outer surface of the cable 2 is exposed out of the through cavities 415 on the front of the stress releasing portion 41, and the rear portion of the stress releasing portion 41 encloses the cable 2.

In the present invention, a plurality of convexes 118,318,418 are axially spaced from one another along an axial direction so as to form a ring like channel between every adjacent two convexes 118,318,418. The convexes 118,318,418 also can be regarded as circumferential ribs. Both through cavities 115,315,415 and the notches 116,316,416 also can be together regarded as dents. A stress releasing portion defines a plurality of through cavities communicating with a receiving passage receiving a cable and a plurality of notches apart from receiving passage. The stress releasing portion can release more effectively stress of the rear portion stress releasing portion for protecting the cable and stress releasing portion from damaging.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A strain relieving element, comprising:

a front surface;

a rear surface opposite to the front surface;

an intermediate portion connecting the front surface to the rear surface;

a receiving passage passing through the front surface and the rear surface;

a plurality of through cavities recessing inwardly from the intermediate portion and communicated with the receiving passage; and a plurality of notches recessing inwardly from the intermediate portion and apart from the receiving passage, wherein the distance between the notches and the rear surface are closer than the distance between the through cavities and the rear surface, wherein the plurality of through cavities are arranged into one row at least, and the plurality of notches are arranged into two rows at least, there is at least two notches in a row of notches, and there is at least two through cavities in a row of through cavities.

2. The strain relieving element as recited in claim 1, wherein the strain relieving element is of a truncated cone-type.

3. The strain relieving element as recited in claim 2, wherein the area of the rear surface is larger than the area of the front surface.

4. The strain relieving element as recited in claim 1, wherein ribs are defined between the same row of the notches, between the same row of the through cavities, respectively.

5. The strain relieving element as recited in claim 4, wherein convexes are defined between two adjacent rows of notches, between two adjacent rows of the through cavities and between the notch and the through cavity, respectively.

6. The strain relieving element as recited in claim 4, wherein the width of the ribs are gradually decreased along a center axis of the strain relieving element from the rear surface to the front surface.

7. The strain relieving element as recited in claim 4, wherein the length of the different rows of the notches, the length of the different rows of the through cavities and the length of the different rows of the ribs are gradually increased along the center axis of the strain relieving element from the rear surface to the front surface.

8. The strain relieving element as recited in claim 5, wherein the height of the ribs are equal to or lower than the height of the convexes.

9. The strain relieving element as recited in claim 5, wherein outer surfaces of the ribs and the convexes are of respectively smooth arc shape, and gradually increased along the center axis of the strain relieving element from the rear surface to the front surface.

10. The strain relieving element as recited in claim 6, wherein the distance between the ribs near to the rear surface and the center axis are longer than the distance between the ribs far from the rear surface and the center axis of the strain relieving element.

11. The strain relieving element as recited in claim 6, wherein the distance between the convexes near to the rear surface and the center axis are longer than the distance between the convexes far from the rear surface and the center axis of the strain relieving element.

12. The strain relieving element as recited in claim 1, wherein the strain relieving element further comprises a connecting portion extending rearwardly from the rear surface for connecting to a connecting member.

13. A cable comprising:

a round columnar body;

a strain relief surround a front end of the round columnar body, said strain relief including:

a plurality of circumferential ribs axially spaced from one another along an axial direction of the round columnar body so as to form a ring like channel between every adjacent two circumferential ribs; and a plurality of dents under each channel to weaken the strain relief; wherein the dents in one channel are radially closer to the round columnar body than those in another channel.

14. The cable as claimed in claim 13, wherein the dents which are radially closer to the round columnar body, reach and expose the columnar body to an exterior radially while the dents radially which are farther from the columnar body do not.

15. The cable as claimed in claim 14, wherein the dents which are radially closer to the columnar body, are located farther axially from the front end of the columnar body than those which are radially farther from the columnar body.

16. The cable as claimed in claim 15, wherein the dents which are axially farther from the front end of the columnar body, are circumferentially dimensioned larger than those which are closer to the front end of the columnar body.

17. The cable as claimed in claim 13, wherein a plurality of axial ribs are formed in each of said channel due to the dents under condition that a transverse width of the axial rib located in the channel closer to the front end of the columnar body, is larger than that of another axial rib located in another channel farther from the front end of the columnar body.

18. The cable as claimed in claim 17, wherein an axial length of the axial rib located in the channel closer to the front end of the columnar body, is smaller than that of another axial rib located farther from the front end of the columnar body.

* * * * *